US006550412B1

(12) United States Patent
Pimentel et al.

(10) Patent No.: US 6,550,412 B1
(45) Date of Patent: Apr. 22, 2003

(54) BOAT ANCHOR

(76) Inventors: Rene Pimentel, 1485 W. 46 St. Apt#510, Hialeah, FL (US) 33014; Raul Pimentel, 880 W. 50 Pl., Hialeah, FL (US) 33012; Roberto Pimentel, 7170 SW. 17 Ter., Miami, FL (US) 33155; Ricardo Pimentel, 14759 Glencairn Rd., Miami Lakes, FL (US) 33016

( * ) Notice: Subject to any disclaimer, the term of this patent is extended or adjusted under 35 U.S.C. 154(b) by 0 days.

(21) Appl. No.: 09/815,651

(22) Filed: Mar. 23, 2001

(51) Int. Cl.[7] ..... B63B 21/44
(52) U.S. Cl. ..... 114/298; 114/306
(58) Field of Search ..... 114/301, 297, 114/298, 304, 306

(56) References Cited

U.S. PATENT DOCUMENTS 3,022,762 A * 2/1962 Hillcourt
4,369,727 A * 1/1983 Fasco ..... 114/297
5,095,842 A * 3/1992 Soules ..... 114/210

* cited by examiner

*Primary Examiner*—Sherman Basinger
(74) *Attorney, Agent, or Firm*—J. Sanchelima; A. Bordas

(57) ABSTRACT

A water craft anchor primarily comprising a shank assembly, arm assembly, and housing. The shank assembly swively connects to the arm members at a predetermined location. The arm members having a common shaft fixedly mounted inbetween. The housing assembly is rotably mounted and partially houses the common shaft and a chain member connects the shank assembly to the housing.

4 Claims, 2 Drawing Sheets

BOAT ANCHOR

II. BACKGROUND OF THE INVENTION

1. Field of the Invention

The present invention relates to a boat anchor, and more particularly, to the type that has a self release mechanism.

2. Description of the Related Art

Boating is a popular sport enjoyed by many. While boating, it is often necessary to set anchor to remain stationary. Various anchors have been designed in the past of many shapes and sizes. However, typically when an anchor is set, it becomes entangled with vegetation or structures on the floor of the body of water. Often, boaters spend much time and energy trying to free an anchor when severely entangled. In extreme cases, one may have to dive into the water to physically disentangle the anchor from the floor or structure it is entangled with.

There is a need for an anchor with a self release mechanism. One that serves the purpose to effectively keep a vessel stationary when anchored, but with a built-in release mechanism to facilitate the deanchoring process.

There are no similar boat anchors to the best of applicant's knowledge, that have a built-in self release mechanism and release when properly positioned.

III. SUMMARY OF THE INVENTION

It is one of the main objects of the present invention to provide a boat anchor that will free itself upon the application of a pulling force opposite from the angle where anchored.

It is another object of this invention to provide an anchor that is easy to raise.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

Figure 3A:
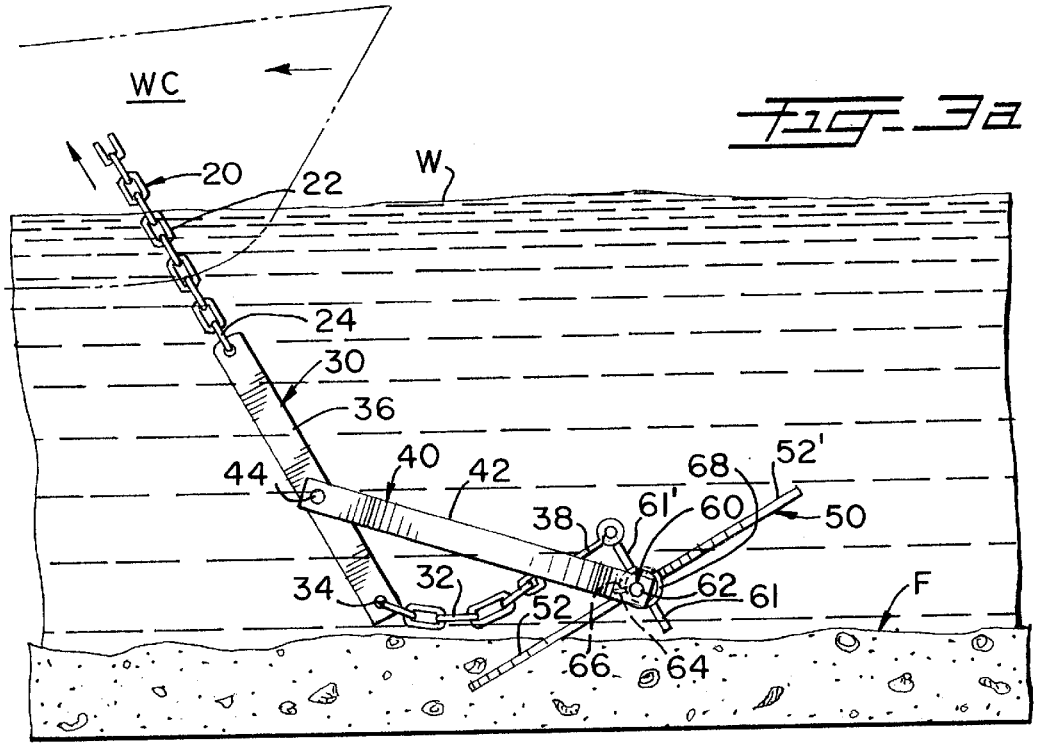

FIG. 3*a* illustrates an elevational side view of the present invention in the anchored position with a water craft in phantom.

Figure 3B:
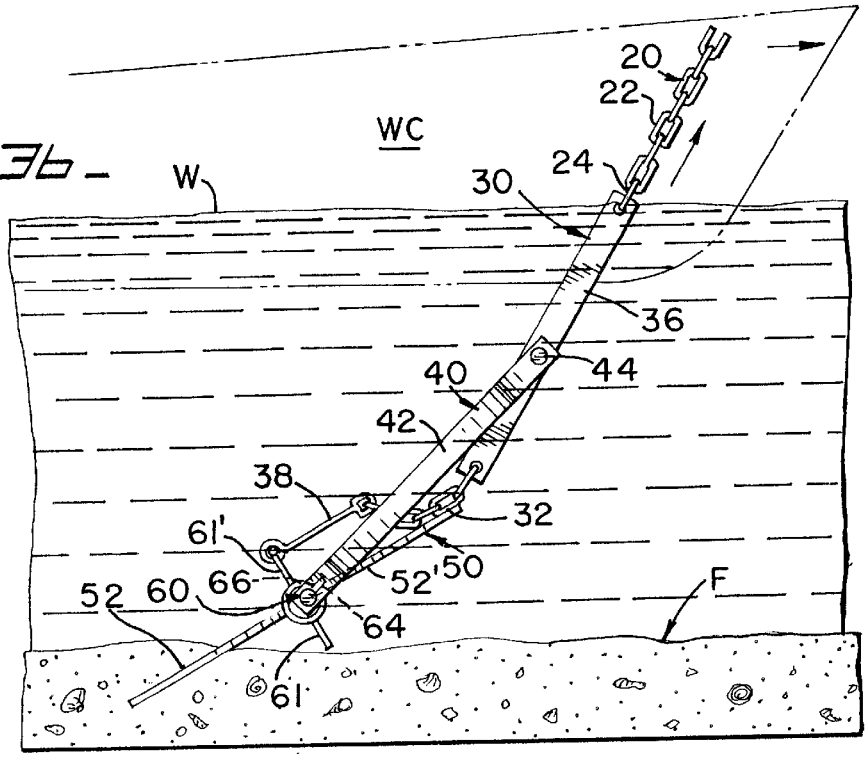

FIG. 3*b* illustrates an elevational side view of the present invention deanchoring with a water craft in phantom.

Figure 4:
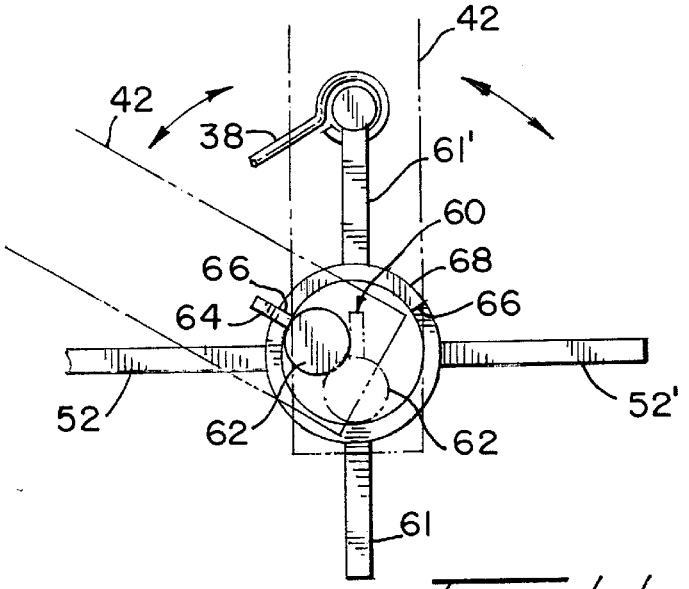

FIG. 4 shows an isometric view of the housing assembly.

V. DETAILED DESCRIPTION OF THE PREFERRED EMBODIMENT

Referring now to the drawings, where the present invention is generally referred to with numeral 10, it can be observed that it basically includes shank assembly 30, arm assembly 40, and housing assembly 50.

Figure 1:
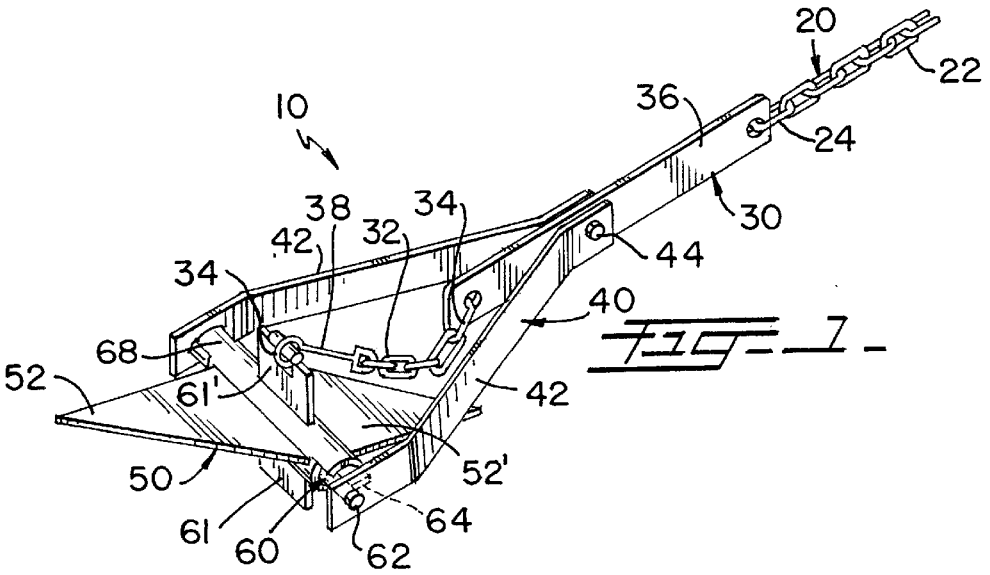
FIG. 1 represents a perspective view of the present invention.

As seen in FIG. 1, boat chain 20 has links 22 interconnected, forming a chain and is fastenly secured to shank assembly 30 by ring 24. Shank 36, as an elongated member, is swively secured to arm assembly 40 by pin 44 and anchor chain 32 by ring 34.

Arm assembly 40 has arms 42 which contain shaft 62 of common shaft assembly 60 and meet at either side of shank 36. In the preferred embodiment, housing assembly 50 has generally triangular flukes 52 and 52' connected to housing 68. Perpendicularly extending from housing 68 are vertexes 61 and 61'. When placed on a surface, vertex 61 creates a fulcrum effect which causes either end of fluke 52 or 52' to contact the surface. Hingedly secured to vertex 61' is connector 38. Connector 38 has ring 34 at its end, which connects to anchor chain 32. Anchor chain 32 is of a length to limit the rotation of housing assembly 50.

Figure 2:
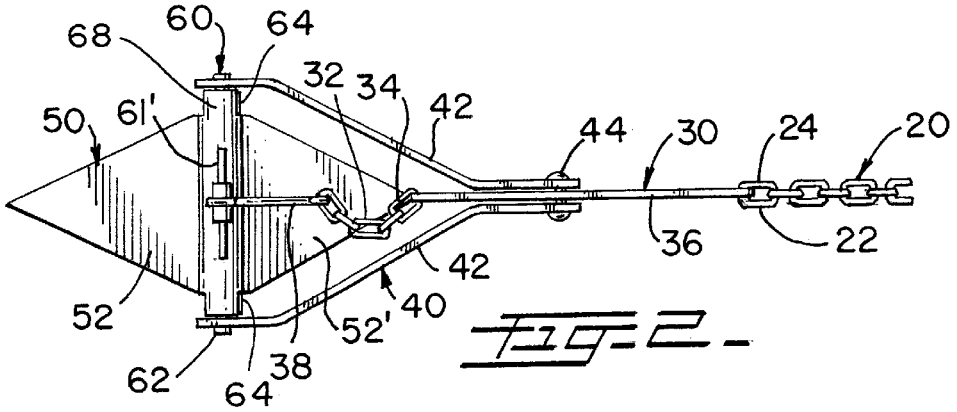
FIG. 2 shows a top view of the present invention.

As seen in FIG. 2, shaft 62, fixedly secured to arms 42, rotates within housing 68. Shank assembly 30 is swively secured inbetween arms 42 by pin 44.

As seen in FIG. 3*a*, instant invention 10 has been placed upon floor F of water W and has anchored. To successfully anchor, fluke 52 or 52' will drag upon floor F momentarily until wedging into floor F or a fixture upon it. In the preferred embodiment, flukes 52 and 52' have identical shapes, and are shaped to facilitate a wedging action. After instant invention 10 secures itself to floor F, water craft WC will generally drift with the current until boat chain 20 is extended. When in the anchored position, fluke 52, in this example, is secured into floor F. Arms 42 raise until tabs 64 of shaft 62 make contact against edges 66. Pulling pressure from boat chain 20 keeps tabs 64 biased against edges 66, thus keeping fluke 52 under pressure and in floor F.

As seen in FIG. 3*b*, water craft WC is in position to deanchor. As water craft WC is positioned to deanchor, boat chain 20 slacks. In this position, as arms 42 lower, tab 64 pressure is removed from edge 66, thus unlocking. This allows arm assembly 40, and shaft 62 to rotate within housing 68. In the unlocked position, fluke 52 easily deanchors as boat chain 20 is pulled.

As best seen in FIG. 4, shaft assembly 60 has shaft 62 with tabs 64 partially covered within generally cylindrical housing 68. In the locked configuration, tab 64 is biased against either edge 66. To unlock and deanchor, arm assembly 40, seen in FIG. 1, is lowered. Upon lowering arm assembly 40, tab 64 pressure is removed from edge 66. This causes shaft 62 to drop within housing 68, allowing tabs 64 to maneuver within and deanchoring is facilitated.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An anchor comprising:

A) a shank assembly having first and second ends, including a pin member transversely mounted through said shank assembly at a predetermined distance from said first end towards said second end without reaching said second end;

B) first and second arm members each having third and fourth ends, said third ends having a shaft fixedly mounted inbetween, said shaft having tabs radially extending at its distal ends, said fourth ends with interconnecting means for connecting with said pin; and C) a fluke assembly having two fluke members rotatably mounted to said shaft, including means for limiting the rotation of said fluke assembly, said means for limiting the rotation of said fluke assembly includes said fluke assembly comprising a housing between and connecting to said fluke members, said housing having edges to cooperate with said tabs where said tabs bias against said edges, and with further including means for disengaging said means for limiting the rotation of said fluke assembly.

2. The anchor set forth in claim 1, wherein said fluke assembly has a chain attached, with means for limiting the rotation of said fluke assembly.

3. The anchor set forth in claim 2, wherein said flukes are triangular in shape.

4. The anchor set forth in claim 3, wherein said housing has first and second vertexes extending perpendicularly therefrom, said first vertex when placed on a surface creates a fulcrum effect, which causes either of said two fluke members to contact said surface.

* * * * *